United States Patent [19]

Horntvedt

[11] Patent Number: 5,056,422

[45] Date of Patent: Oct. 15, 1991

[54] FUME HOOD APPARATUS

[75] Inventor: Earl Horntvedt, Manitowoc

[73] Assignee: Hamilton Industries, Inc., Two Rivers, Wis.

[21] Appl. No.: 564,789

[22] Filed: Aug. 9, 1990

[51] Int. Cl.[5] ..... B05B 15/02

[52] U.S. Cl. ..... 98/115.3

[58] Field of Search ..... 98/115.1, 115.3

[56] References Cited

U.S. PATENT DOCUMENTS

| | | | |
|---|---|---|---|
| 2,573,290 | 10/1951 | Van Guilder . | |
| 3,049,069 | 8/1962 | Whiston et al. | 98/115.3 |
| 3,713,785 | 1/1973 | Moran | 98/115.3 |
| 3,715,972 | 2/1973 | Kelso et al. | 98/115.3 |
| 3,941,040 | 3/1976 | Carlson | 98/115.3 |
| 4,142,458 | 3/1979 | Duym | 98/115.3 |
| 4,197,646 | 4/1980 | Morrison | 98/115.3 X |
| 4,312,291 | 1/1982 | Knab | 98/115.3 X |
| 4,872,400 | 10/1989 | Brown et al. | 98/115.3 |

FOREIGN PATENT DOCUMENTS

| | | | |
|---|---|---|---|
| 266345 | 11/1987 | Japan | 98/115.3 |

*Primary Examiner*—Harold Joyce

*Attorney, Agent, or Firm*—Tilton, Fallon, Lungmus & Chestnut

[57] ABSTRACT

A fume hood includes an elongate tubular frame member which defines an elongate chamber, an inlet to the chamber, and an outlet from it. It also includes partitions secured to the frame member. Those partitions define a work space from which the frame member receives gases through its inlet.

15 Claims, 3 Drawing Sheets

FIG. 1
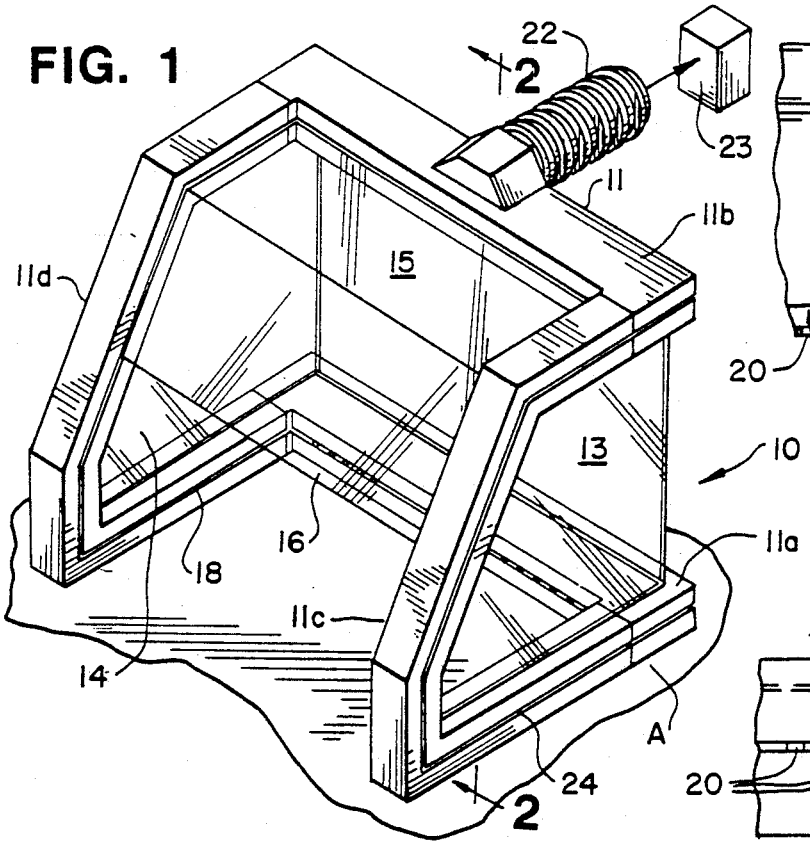
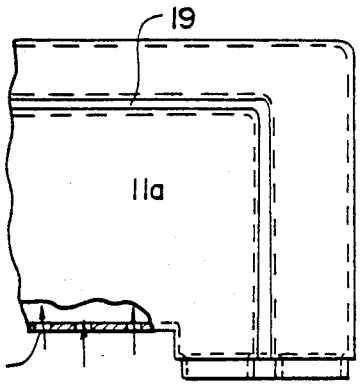
FIG. 3
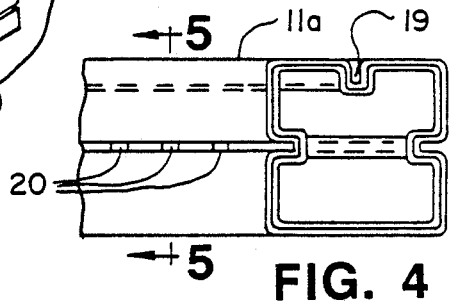
FIG. 4
FIG. 2
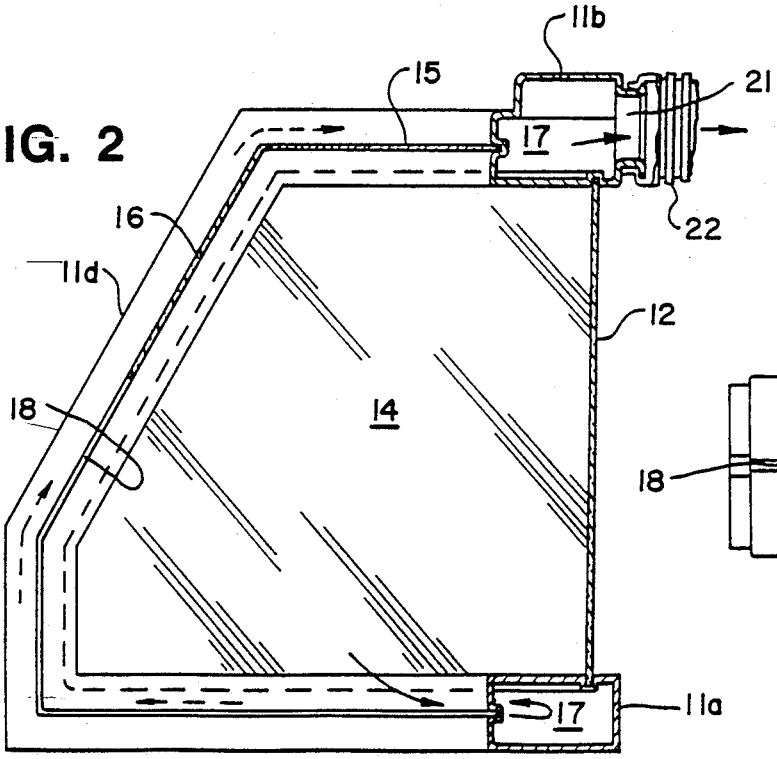
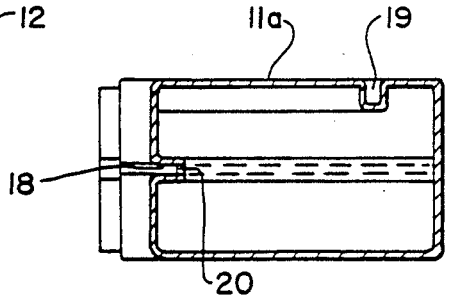
FIG. 5

FUME HOOD APPARATUS

BACKGROUND OF THE INVENTION

1. Field Of The Invention

The present invention relates to a fume hood apparatus, and more particularly to a fume hood apparatus with a frame which facilitates the removal of fumes or gases.

2. Description Of The Prior Art

Fume hoods are protective enclosures which provide ventilated and illuminated work spaces for laboratory or other applications. Prior art fume hoods provide such workspaces using complex structures with a multiplicity of components. These constructions require costly materials, and costly manufacture and assembly processes and installation procedures.

Unlike prior fume hoods, the fume hood of the present invention is of simple construction. It includes partitions which define a workspace and an elongate frame through which it evacuates the workspace of fumes. This fume hood minimizes the expense of manufacture and assembly. It includes a small number of components which provide an effective, well-ventilated workspace.

SUMMARY OF THE INVENTION

In accordance with this invention, a fume hood apparatus includes an elongate frame member of a predetermined configuration which defines an elongate chamber, inlet means for receiving fumes or gases, and outlet means for discharging them. This frame is a tube made of metal or any other material of high strength and rigidity. It conveys fluids and provides structural integrity to the fume hood.

The fume hood also includes partition means secured to the frame member for defining a workspace. The partition means are transparent panels which allow an unobstructed view of the workspace. For example, the partition means may include sheets of plexiglass or any other suitable shatterproof material. Alternatively, the partition means may be sheets of any suitable translucent or opaque material of high strength and rigidity which can serve as a sidewall.

A high volume centrifugal fan disposed in fluid communication with the outlet of the frame member evacuates the chamber of the frame member of any fumes. In drawing gases from the frame member, it builds up a negative pressure in the chamber of the frame member. This negative pressure induces the flow of fumes or other gases in the workspace through the inlet means of the frame, through its chamber, and out through the outlet means.

BRIEF DESCRIPTION OF THE DRAWINGS

For a more complete understanding of this invention, one should now refer to the embodiments illustrated in greater detail in the accompanying drawings and described below by way of examples of the invention. In the drawings:

FIG. 1 is a perspective view of one embodiment of the fume hood of the present invention.

FIG. 2 is a sectional view taken along line 2—2 in FIG. 1.

FIG. 3 is a top plan view of a frame segment (Detail A in FIG. 1).

FIG. 4 is a front elevation view of the frame segment shown in FIG. 3.

FIG. 5 is a sectional view taken along line 5—5 in FIG. 4.

Figure 6:
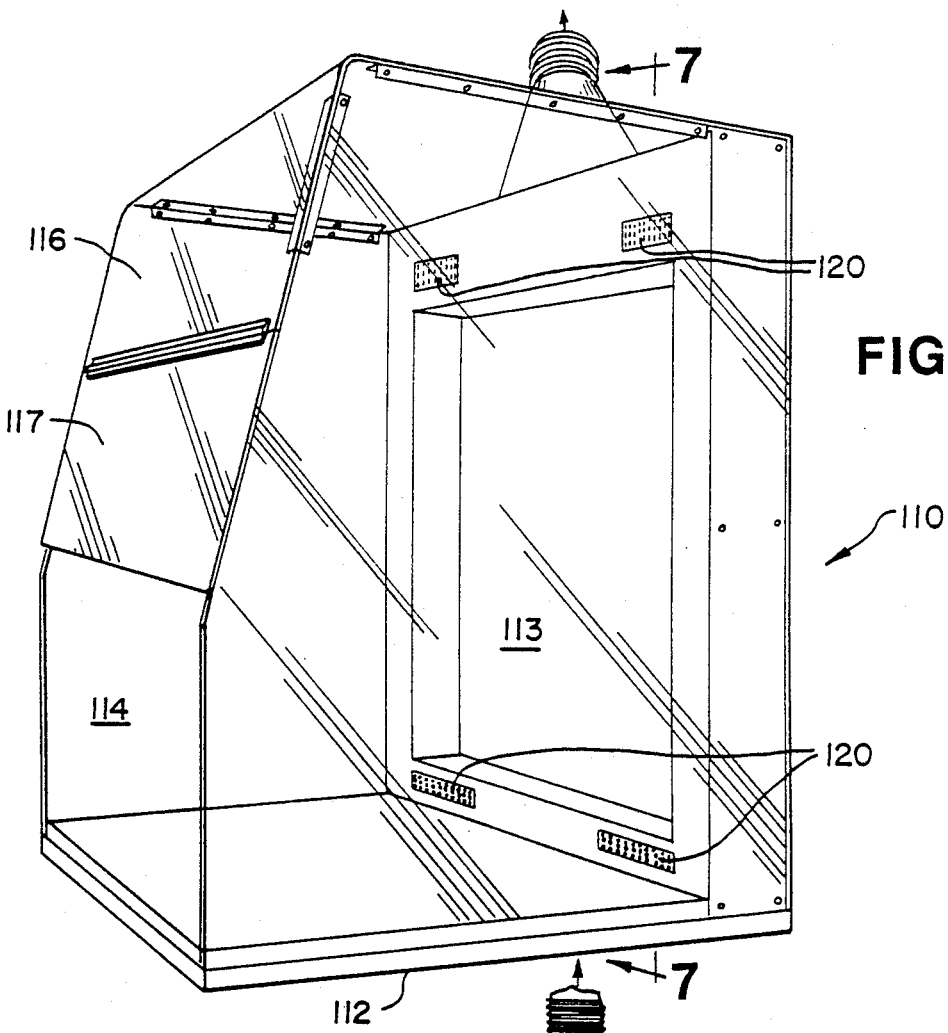
FIG. 6 is a perspective view of a second embodiment of the fume hood of the present invention.

While the following disclosure describes the invention in connection with three embodiments, one should understand that the invention is not limited to those embodiments. Furthermore, one should understand that the drawings are not to scale and that graphic symbols, diagrammatic representations or fragmentary views may, in part, illustrate the embodiments. In certain instances, the disclosure may not include details which are not necessary for an understanding of the present invention.

DETAILED DESCRIPTION OF THE DRAWINGS AND EMBODIMENTS

Turning now to the drawings, FIGS. 1–5 illustrate one embodiment of the fume hood apparatus of the present invention at 10. The fume hood generally includes an elongate frame 11, a back panel 12, two side panels 13 and 14, and two top panels 15 and 16. The frame 11 provides structural integrity to the fume hood 10 and facilitates the discharge of fumes from within it. It includes a bottom segment 11*a*, a top segment 11*b*, and a pair of side segments 11*c* and 11*d*. These segments 11*a–d* are hollow tubes having a generally rectangular cross-section and made out of sheet metal or any other suitable material of high strength and rigidity, e.g., molded plastic.

The tube segments 11*a*–d form a continuous tube with a bottom portion having a generally U-shaped configuration, a top portion with a similar configuration, and two connecting portions. (The bottom portion lies on a flat horizontal surface as shown in FIG. 1.) These segments also define a continuous chamber 17 through which the fume hood 10 discharges fumes. Finally, the segments 11*a*–d define a first continuous groove 18 which receives edge portions of the panels 15 and 16 and a second continuous groove 19 which receives edge portions of the panels 12, 13, and 14.

The panel 12 extends between frame segments 11*a* and 11*b*. It has a rectangular configuration and opposite edge portions which extend into opposite portions of the continuous groove 19. It is the back wall of the fume hood 10. The panels 13 and 14 extend between portions of the frame segments 11*c* and 11*d*, respectively, and they have edge portions which extend into the groove 19. They form the fume hood sidewalls. The panels 15 and 16 extend between the segments 11*c* and 11*d*. They have a rectangular configuration and opposite edge portions which extend into opposite portions of the groove 18. One edge portion of the panel 15 also extends into the portion of the groove 18 formed by the segment 11*b*. The panels 15 and 16 define the top wall of the fume hood.

The panels 12–16 are sheets of transparent material, e.g., plexiglass, which is shatterproof and does not pose a safety hazard. Transparent panels allow easy viewing of the workspace defined by the frame 11 and the panels 12–16. Individuals standing anywhere around the fume hood 10 may easily observe activity within the hood. Alternatively, the panels 12–16 may be any other suitable translucent or opaque material of high strength and rigidity.

In constructing the fume hood 10, the first step includes inserting the edge portions of the panels 13 and 14 in the groove 19 of frame segments 11*c* and 11*d*, respectively, and the edge portions of the panels 15 and 16 in the groove 18 of the segments 11*b–d* (Stops, not shown, placed in the groove 18 secure the panel 16 in the position shown in FIG. 1). The other steps of this procedure include placing the panel 12 in place between the segments 11*a* and 11*b*, connecting the segments 11*a* and 11*b* with the segments 11*c* and 11*d*, and tack welding the segments 11*a*–d together as shown in FIG. 1.

The opposite end portions of the segments 11*a* and 11*b* have reduced cross-sections to facilitate telescoping connections with the corresponding end portions of the segments 11*c* and 11*d* (See FIGS. 3 and 4). In addition, to prevent damage to the edge portions of the panels 12–16, the fume hood includes gasket strips made of rubber o other suitable resilient material placed in the grooves 18 and 19 for cushioning the contact between the panels and the frame. Alternatively, silicon placed in the grooves may serve the same function.

The frame 11 includes inlet openings 20 formed in frame segment 11*a*. However, the frame may include other inlet openings in the other segments of the frame. (In addition, one may vary the size of the inlet openings to adjust the draw of fumes from the various locations in the hood.) The frame also includes an outlet 21 (See FIG. 2) through which fumes discharge from the frame. A conduit 22 releasably secured to the frame 11 connects the outlet 21 to a high volume centrifugal fan 23 which draws the fumes from the workspace provided by the fume hood 10 through the frame 11 and out of the fume hood.

Figure 7:
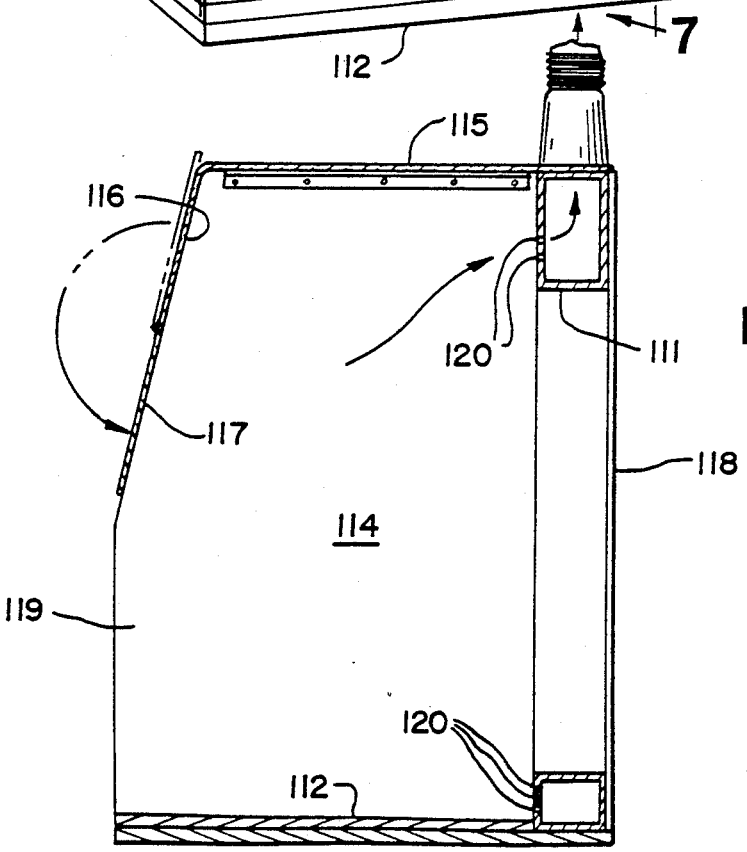
FIG. 7 is a sectional view taken along line 7—7 in FIG. 6.

FIGS. 6 and 7 illustrate another embodiment of the fume hood of the present invention generally at 110. This fume hood 110 includes an elongate frame 111 formed into a rectangular loop. It also includes a base 112 secured to the bottom of the frame 111, side panels 113 and 114 and secured to opposite sides of the frame 111, a top panel 115 secured to the top of the frame 111 and the panels 113 and 114, a first front panel 116 secured to the panels 113 and 114, a second front panel 117 hingedly connected to the panel 116, and a back panel 118 secured to the back of the frame 111. An opening 119 allows access to the inside of the fume hood 110.

The materials used to form the frame 111 and the panels 113–117 of the second embodiment are the same or similar to those used to form the fume hood 10. Similarly, as in the first embodiment, the frame 111 includes inlet openings 120 and an outlet opening (not shown) to facilitate the evacuation of fumes from the inside of the fume hood 110. A high volume centrifugal fan (not shown) cooperates with the frame 111 to remove the fumes.

Figure 8:
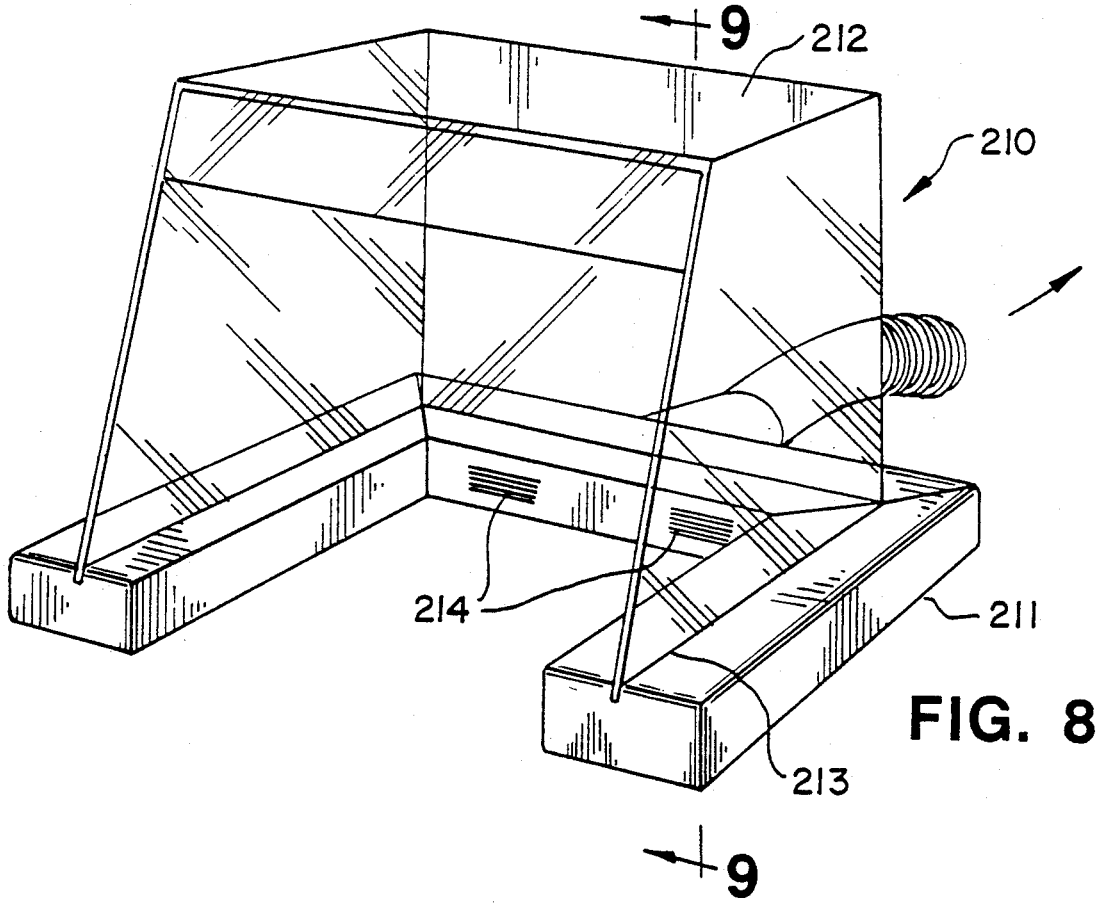
FIG. 8 is a perspective view of a third embodiment of the fume hood of the present invention.
Figure 9:
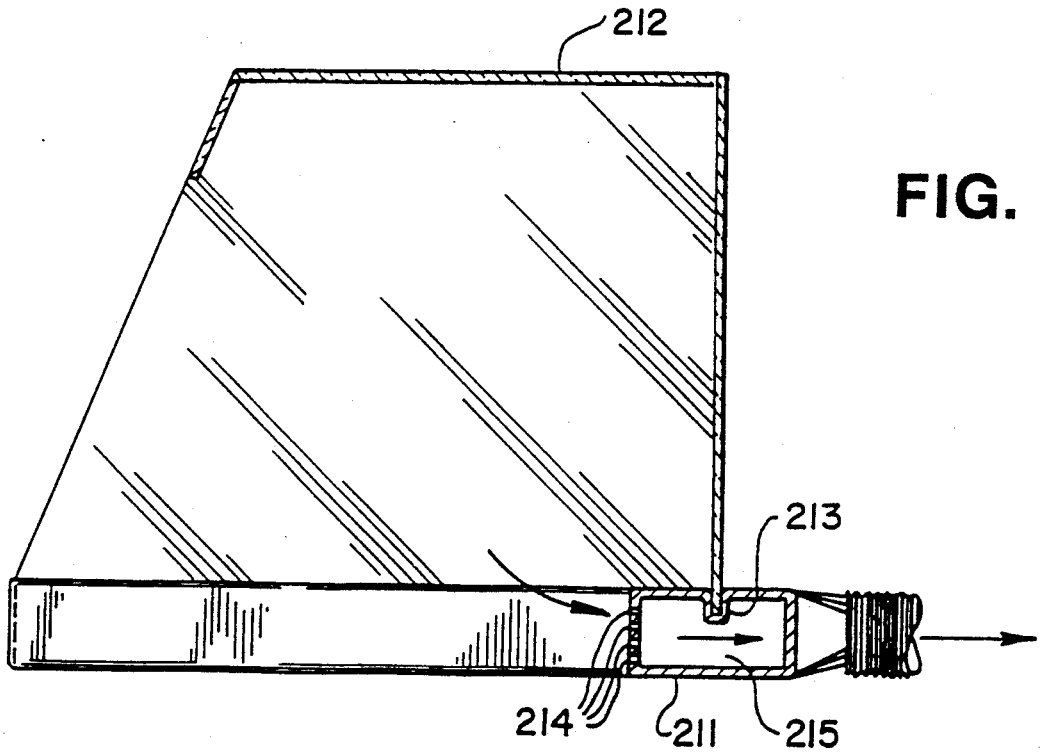
FIG. 9 is a sectional view taken along line 9-9 in FIG. 8.

FIGS. 8 and 9 show yet another embodiment of the fume hood of the present invention at 210, including a frame 211 having a generally U-shaped configuration and a transparent cover 212 with bottom edge portions which extend into a groove 213 formed into the top of the frame 211. The cover 212 includes a plurality of panels adhered or otherwise fixedly secured to each other as shown. The frame 211 is a pedestal which supports the cover 212. It defines inlet openings 214, and elongate chamber 215, and an outlet (not shown). It provides structural integrity to the fume hood 210 and facilitates evacuation of fumes from the inside of the fume hood with a high volume centrifugal fan. The materials used to construct the frame 211 and the cap 212 are the same or similar materials used to construct the frame and panels in the first and second embodiments described above.

While the above description and the drawings disclose and illustrate three embodiments, one should understand, of course, that the invention is not limited to those embodiments. Those skilled in the art to which the invention pertains may make modifications and other embodiments employing the principles of this invention, particularly upon considering the foregoing teachings. The applicant intends to cover any such modifications which incorporate those features which constitute the essential features of this invention.

What is claimed is:

1. A fume hood comprising: an elongate frame member for the entire fume hood, said frame member having a circuitous configuration and defining peripheral edge portions of the fume hood, said frame member also defining an elongate and circuitous chamber, inlet means for receiving gases, and outlet means for discharging gases, the gases flowing into the inlet, through the chamber, and out through the outlet; and panel means secured to the frame member for cooperating with the frame member to define an enclosed work space.

2. The fume hood of claim 1, wherein the frame member in a thin-walled tube.

3. The fume hood of claim 1, wherein the frame member includes groove means for receiving the partition means.

4. The fume hood of claim 1, wherein the frame member includes a predetermined length which is the bottom portion and has a generally U-shaped configuration, a predetermined length which is the top portion and has a generally U-shaped configuration, and a predetermined length which forms a pair of spaced-apart connecting portions.

5. The fume hood of claim 4, wherein the panel means includes a plurality of panels.

6. The fume hood of claim 5, wherein the panels are transparent.

7. The fume hood of claim 4, wherein the frame member has a rectangular cross-section.

8. The fume hood of claim 7, wherein the frame member is made of sheet metal.

9. The fume hood of claim 1, further comprising suction means in fluid communication with the outlet means for moving gases from the work space, through the frame, and out through the outlet means.

10. In a fume hood having panel means for defining an enclosed work space, an elongate frame member for the entire fume hood has a circuitous configuration and defines peripheral edge portions of the fume hood, said frame member removes gases from the work space and also defines an elongate chamber, inlet means for receiving the gases, and outlet means for discharging the gases.

11. The fume hood of claim 10, wherein the frame member is a thin-walled tube.

12. The fume hood of claim 10, wherein the frame member includes groove means for receiving the panel means.

13. The fume hood of claim 10, wherein the frame member includes a bottom portion having a generally U-shaped configuration, a top portion having a generally U-shaped configuration, and a pair of connecting portions.

14. The fume hood of claim 13, wherein the frame member has a rectangular cross-section.

15. The fume hood of claim 14, wherein the frame member is made of sheet metal.

* * * * *